US008769718B2

(12) United States Patent
Riehl

(10) Patent No.: US 8,769,718 B2
(45) Date of Patent: Jul. 8, 2014

(54) GARMENT

(76) Inventor: Shari Riehl, West Labanon, NH (US)

( * ) Notice: Subject to any disclaimer, the term of this patent is extended or adjusted under 35 U.S.C. 154(b) by 562 days.

(21) Appl. No.: 12/788,353

(22) Filed: May 27, 2010

(65) Prior Publication Data

US 2010/0299797 A1 Dec. 2, 2010

Related U.S. Application Data

(60) Provisional application No. 61/181,687, filed on May 28, 2009.

(51) Int. Cl.
*A41D 7/00* (2006.01)

(52) U.S. Cl.
USPC ..... 2/67

(58) Field of Classification Search
USPC ..... 2/105, 212, 67, 70, 74, 75, 71, 912; 450/11, 30, 31, 95; D2/25, 40, 731, D2/735
See application file for complete search history.

(56) References Cited

U.S. PATENT DOCUMENTS

| | | | | | |
|---|---|---|---|---|---|
| 1,077,687 | A | * | 11/1913 | Dyrenforth | 450/31 |
| 1,552,733 | A | * | 9/1925 | Rhoden | 2/71 |
| 1,666,504 | A | * | 4/1928 | Pelton | 450/31 |
| 1,691,790 | A | * | 11/1928 | Volker | 2/71 |
| 1,800,461 | A | * | 4/1931 | Mattern | 2/67 |
| 1,844,888 | A | * | 2/1932 | Lorenz | 450/31 |
| 1,889,701 | A | * | 11/1932 | Rosenberg | 2/78.1 |
| 1,994,990 | A | * | 3/1935 | Flesh | 450/33 |
| 2,040,561 | A | * | 5/1936 | Meinig | 450/34 |
| 2,118,958 | A | * | 5/1938 | Watinsky | 2/67 |
| 2,438,062 | A | * | 3/1948 | Licht | 450/30 |
| 2,468,346 | A | * | 4/1949 | Rayden | 450/105 |
| 2,812,516 | A | * | 11/1957 | Hoffman | 2/80 |
| 2,875,763 | A | * | 3/1959 | Marchisella | 450/8 |
| 3,040,751 | A | * | 6/1962 | Mastenbrook | 450/105 |
| 3,064,265 | A | * | 11/1962 | Bridgewaters | 2/74 |
| 3,154,789 | A | * | 11/1964 | Lewis, Jr. | 2/104 |
| 3,224,448 | A | * | 12/1965 | Diebold | 450/105 |
| 3,771,172 | A | * | 11/1973 | Barg | 2/67 |
| 4,152,782 | A | * | 5/1979 | Kincaid | 2/74 |
| 4,894,919 | A | * | 1/1990 | Ziegert | 33/17 R |
| 5,184,968 | A | | 2/1993 | Michalochick et al. | |
| 5,996,120 | A | | 12/1999 | Balit | |
| 6,223,351 | B1 | | 5/2001 | Marie | |
| 6,276,176 | B1 | | 8/2001 | Blakely | |
| 6,298,486 | B1 | * | 10/2001 | Huang | 2/78.1 |
| 6,443,805 | B1 | * | 9/2002 | Kirkwood | 450/31 |
| 6,463,765 | B2 | | 10/2002 | Blakely | |

(Continued)

OTHER PUBLICATIONS

Selected SlimPerfectTM swimwear website pages; photos of a purchased SlimPerfectTM swimwear; the hang tag label on the purchased swimwear; and attached explanation of such copies, photos, and swimwear.

*Primary Examiner* — Khoa Huynh
*Assistant Examiner* — Anna Kinsaul

(57) ABSTRACT

A garment including an inner layer of material adapted to be disposed adjacent to a wearer's skin. The inner layer preferably forms a body suit with legs formed of elastic, body-shaping material that includes a bodice portion and torso/legs portion. The garment also includes at least one exterior layer that may be fashioned as a skirt, a dress, a long-legged pants, a jumpsuit, or similar attire. A construction of a body suit with legs as well as a method for making the torso/legs portion is also disclosed.

15 Claims, 6 Drawing Sheets

(56) References Cited

U.S. PATENT DOCUMENTS

| | | | | |
|---|---|---|---|---|
| 6,530,820 | B1 * | 3/2003 | Katze et al. | 450/7 |
| 7,024,892 | B2 | 4/2006 | Blakely | |
| 7,260,852 | B2 * | 8/2007 | Sheetz | 2/67 |
| 2007/0101481 | A1 * | 5/2007 | Stokesbary | 2/211 |
| 2008/0256676 | A1 | 10/2008 | DiLorenzo | |
| 2009/0071197 | A1 | 3/2009 | Albiero et al. | |
| 2009/0205098 | A1 * | 8/2009 | Araquistain | 2/50 |
| 2011/0179555 | A1 * | 7/2011 | Bickley et al. | 2/401 |

* cited by examiner

GARMENT

CROSS-REFERENCE TO RELATED APPLICATIONS

The present application is a non-provisional patent application of, and claims priority to and the benefit of, U.S. Provisional Patent Application No. 61/181,687, filed May 28, 2009 entitled "Apparel Especially Suitable For Use As Women's Swimwear", which is hereby incorporated by reference in its entirety.

FIELD OF THE INVENTION

The present invention relates to a garment, especially a garment that is adapted to be used as swimwear, active wear, and casual wear.

BACKGROUND OF THE INVENTION

The present invention was developed primarily in response to the need of women for very comfortable, yet feminine and aesthetically attractive, garments during activities such as swimming, aerobics, tennis, boating, jogging, gardening, and dancing, and casual activities such as dining and shopping. Such garments should be comfortable and stylish prior to, during, and after such activities, without requiring a change of clothing.

For example, women wear swimsuits when walking on a beach, lounging near a pool, or while swimming. Women wearing conventional swimsuits usually are self-conscious and concerned about their appearance, often feeling exposed and subject to the critical evaluation of their bodies by others in their vicinity. When a woman wearing a conventional swimsuit leaves the environ of a beach or a pool, she tends to be even more self-conscious of her appearance and prefers to be even more modestly attired, and will usually wrap a towel or cloth around her torso or change her clothing. Such clothing modifications pose an encumbrance on the freedom of a woman to go to and leave the beach or the pool. Sometimes, bags containing extra articles of clothing must be carried, and in the case of a woman wrapping a towel around her torso, for example, the woman often still feels exposed or unattractive. Similar issues arise for women when they are wearing an aerobic work-out suit, for example.

The present invention was developed with a desire to provide light-weight, quick-dry, body-shaping and enhancing, feminine garment that will permit woman to engage in a variety of activities, including swimming, while also serving as casual wear, without the need for any additional attire or any change of clothing. The garment effects body forming, shaping and smoothing functions together with a stylish appeal, thereby boosting a woman's confidence in her appearance during such activities. The garment may be especially advantageous used when traveling on vacation, such as while on a cruise, at a resort, or at a beach hotel.

Although the genesis of the present invention arose from a need to help women in connection with their attire, the invention should not be interpreted as being restricted to women's attire, and should not be understood as requiring all of the aforementioned advantageous features of the garment.

SUMMARY OF THE INVENTION

The present invention relates to a garment including an inner layer of material adapted to be disposed adjacent to a wearer's skin. The inner layer preferably forms a body suit with legs formed of elastic, body-shaping material that includes a bodice portion and torso/legs portion. The garment also includes at least one exterior layer that may be fashioned as a skirt, a dress, a long-legged pants, a jumpsuit, or similar attire. A construction of a body suit with legs as well as a method for making the torso/legs portion is also disclosed.

BRIEF DESCRIPTION OF THE DRAWINGS

The invention will be described with reference to the accompanying drawings wherein.

DESCRIPTION OF A PREFERRED EMBODIMENT

Figure 2:
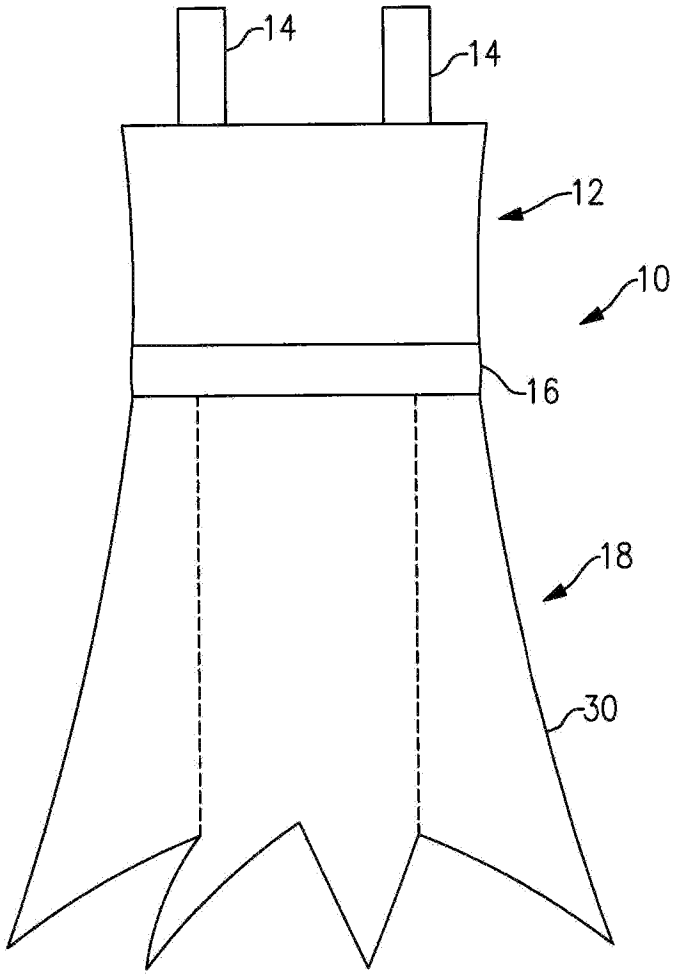
FIG. 2 is a plan view of the back of the garment shown in FIG. 1.

The present invention will be described with reference to the accompanying drawings wherein like reference numerals refer to the same item.

Figure 1:
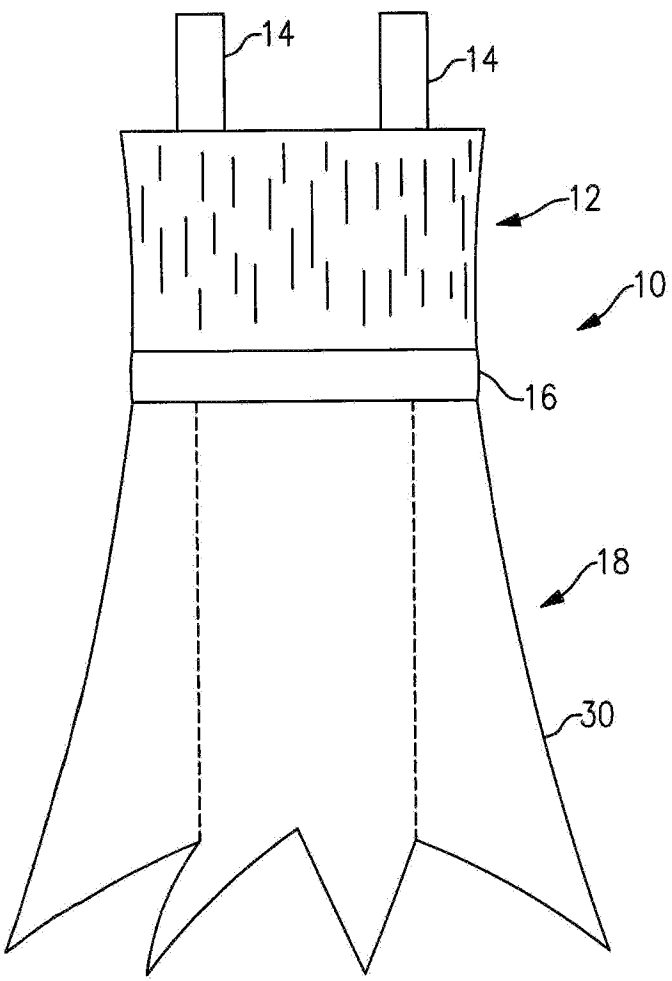
FIG. 1 is a plan view of the front of a garment in accordance with one embodiment of the present invention.

There shown in FIGS. 1 and 2 the front and back views of a garment 10 in accordance with a preferred embodiment of the present invention. In the described preferred embodiment, the garment 10 includes an inner layer comprising a shaping and smoothing body suit with legs, an intermediate layer comprising a dress, and an outer layer comprising a decorative overlay preferably formed of a sheer mesh fabric. The outer layer, being decorative, may be eliminated from the garment 10, if desired. The garment 10 includes an upper bodice section 12 that generally covers the upper torso of the wearer, and particularly covers the breast area of the wearer. As shown in FIGS. 1 and 2, the bodice section 12 possesses a substantially equal height in the front and the back, although it should be understood that the relative heights and shapes may vary. For example, the upper edges of both the front and the back of the bodice section 12 may be straight and at either the same or different vertical heights, the back portion may be fashioned in a substantially "U"-shaped upper peripheral configuration, the front portion of the bodice may include a slight "V"-shaped configuration, and the bodice section 12 may completely cover the wearer's upper torso, including over the shoulders. The invention also contemplates that arms (not shown) may be attached to the bodice section 12.

As shown in FIGS. 1 and 2, a pair of shoulder straps 14 are attached to the upper bodice section 12 by means of sewing, buttons, snaps, or the like, whereby the shoulders of the wearer help support the bodice section 12 and maintain the garment 10 in a selected position on the wearer. The shoulder straps 14 may be of varying widths, may include more than one strap per shoulder, may comprise only a single strap, or need not be employed at all so that the garment 10 is substantially self-supporting on the wearer's body without being suspended from the wearer's shoulders. The length of a shoulder strap 14 may be adjustable in length. Further, each shoulder strap 14 may be either permanently or detachably secured to the bodice section 12 or may be adapted to be selectively tied in a loose knot or bow to another shoulder strap 14 around the wearer's neck. Each shoulder strap 14 may also be formed in a front segment and a back segment that may be secured together by tying their ends in a loose knot or bow.

The garment 10 also includes a waist band 16 generally extending around and about the waist region of the wearer, anywhere from a point slightly below the breasts to the waist. The waist band 16 may be fashioned of either a non-elastic material or an elastic material that helps clasp the waist area of the garment 10 against the waist of the wearer, thereby both tending to decrease the circumference of the wearer's waist, and also helping to maintain the garment 10 in a desirable position about the wearer. The waist band may also include a pair of waist straps, one end of each strap being secured along a corresponding lateral side of the waist band. Each strap is of a length sufficient to wrap around the back of the wearer and around the other lateral side of the wearer, and to be tied in a loose knot as a bow with the other strap in front of the wearer. The waist straps thus provide additional means for tightening against and compressing the waist of the wearer while providing an additional, optional decorative embellishment. As will be appreciated from reading further about the preferred embodiment, the waist band 16 is optional and need not be employed with the garment 10.

The garment 10 also includes a lower, skirt section 18 that depends from the waist band 16 to a point that may be above, at, or below the knee of the wearer.

As best shown in FIG. 1, the outer layer of the bodice section 12, which is preferably formed of a sheer mesh material, is decoratively fashioned with tuck pleats about the upper and lower edges, which are secured such as by sewing, so that outer layer of the bodice 12 possesses a series of substantially equally spaced, vertically oriented creases, which create an aesthetically pleasing appearance for the bodice section 12. As an alternative, the outer layer of the bodice section 12 may be ruffled or otherwise decoratively fashioned. Again, it should be appreciated that such tuck pleats, ruffles, and other decorative elements are an optional feature of the present invention.

Likewise the outer layer of the skirt section 18, which is preferably fashioned of a sheer mesh material, is shown as fashioned with an uneven hem depicting four depending serrations or scarf features. The front and the rear outer layers of the skirt section 18 may include a pair of vertically oriented pleats, which are indicated by the dashed lines in FIGS. 1-4. The aesthetic features of the hem line and the pleats are optional in accordance with the present invention.

Figure 5:
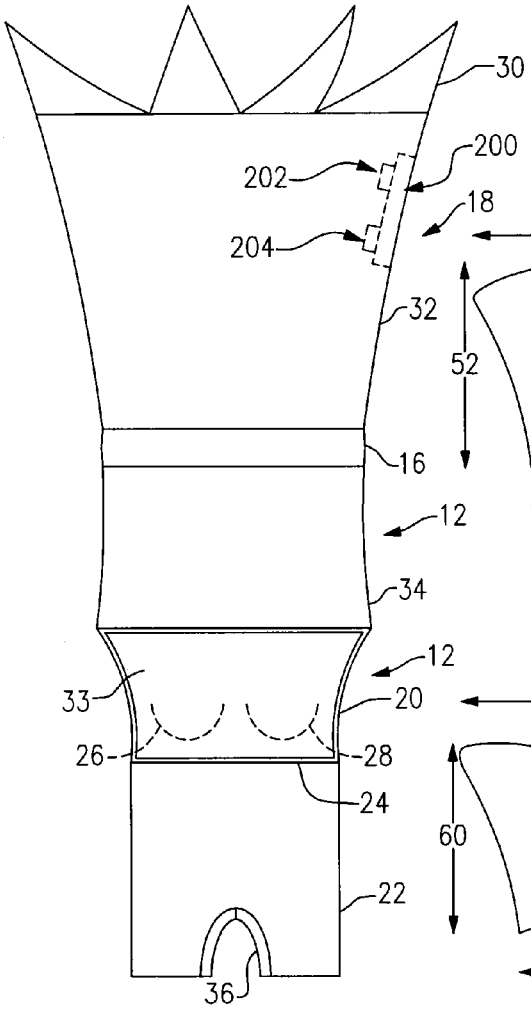
FIG. 5 is a plan view of the front of garment shown in FIG. 1 with the outer layers of the garment pulled upwardly and inside-out to expose the inner layer.

FIG. 5 depicts the intermediate and outer layers of the garment 10 pulled upwardly and inside-out from an inner layer of the garment 10, which inner layer surroundly conforms to and is disposed against the body of the wearer of the garment 10, generally in the region of the bodice, torso, buttocks, hips, and the upper thighs. The inner layer of the garment 10 is preferably fashioned of an elastic material that helps to forcefully compress the inner layer against the wearer's body and to help shape the user's body in a desirable fashion, such as to decrease the circumference of the waist region and to smooth the bodice, buttocks, hips, and thighs. Thus, the inner layer forms a body-shaping suit with legs and provides internal shapewear for the garment 10. As shown in FIG. 5, the inner layer includes an upper, bodice portion 20 and a lower, torso/legs portion 22. The upper bodice portion 20 and the torso/legs portion 22 are joined such as by stitching along a horizontal seam 24. In an alternate embodiment, the inner layer may include an elastic waist band, similar to the waist band 16, to which the bodice portion 20 and the torso/legs portion 22 are each joined. Such a waist band may be located immediately below the breast area to provide additional support for the breasts.

The bodice portion 20 of the inner layer is preferably fashioned as a single layer of elastic material that helps support the wearer's breasts without severely compressing against the breasts. Also, the bodice portion 20 preferably possesses a pair of underwire channelings indicated by the dashed lines 26, 28 in FIG. 5. The channelings may be fashioned of the same material or of a different material from that forming the bodice portion 20, and may, for example, be fashioned of cotton, a cotton blend, or another soft fabric to enhance comfort. Each of the underwire channelings 26, 28 is adapted to receive a conventional corresponding underwire therethrough so as to be disposed beneath and to support a wearer's breasts. The underwire channelings 26, 28 and the underwires are also an optional feature of the present invention.

The torso/legs portion 22 of the inner layer possesses a pair of legs that preferably depend about three to eight inches below the wearer's crotch. The invention contemplates that different leg lengths may be employed, such as shorter than three inches, to just above the knee, to the knee, and to below the knee of the wearer. An internal layer of cotton, a cotton blend, or another soft fabric may line the torso/legs portion 22, especially in the region of the crotch, for added comfort.

The skirt section 18 of the garment 10 is sufficiently long to completely cover and hide the torso/legs portion 22 of the inner layer. The invention contemplates, however, that the skirt section 18 of the garment 10 may not cover the entire torso/legs portion 22 of the inner layer.

As is also shown in FIG. 5, the skirt section 18 includes preferably both an outer decorative overlay 30 as well as the bottom portion 32 of a dress that forms the intermediate layer. The bottom portion 32 of the dress also preferably depends from the waist band 16 and may be secured to the waist band 16 such as by stitching. Preferably the bottom portion 32 of the dress possesses a straight hem, as shown toward the top of FIG. 5 and is fashioned of an opaque material, which will further help to hide the torso/legs portion 22 of the inner layer.

Preferably the bodice section 12 of the garment 10 includes the upper portion 34 of the dress and a thin layer of padding 33, such as one-eighth inch thick foam padding, interposed between the bodice portion 20 of the inner layer and the upper portion 34 of the dress. The padding preferably possesses the same configuration and size as the front of the upper bodice section and is secured such as by stitching along its top, lateral, and bottom edges to the bodice portion 20 of the inner layer and the upper portion 34 of the dress.

Figure 3:
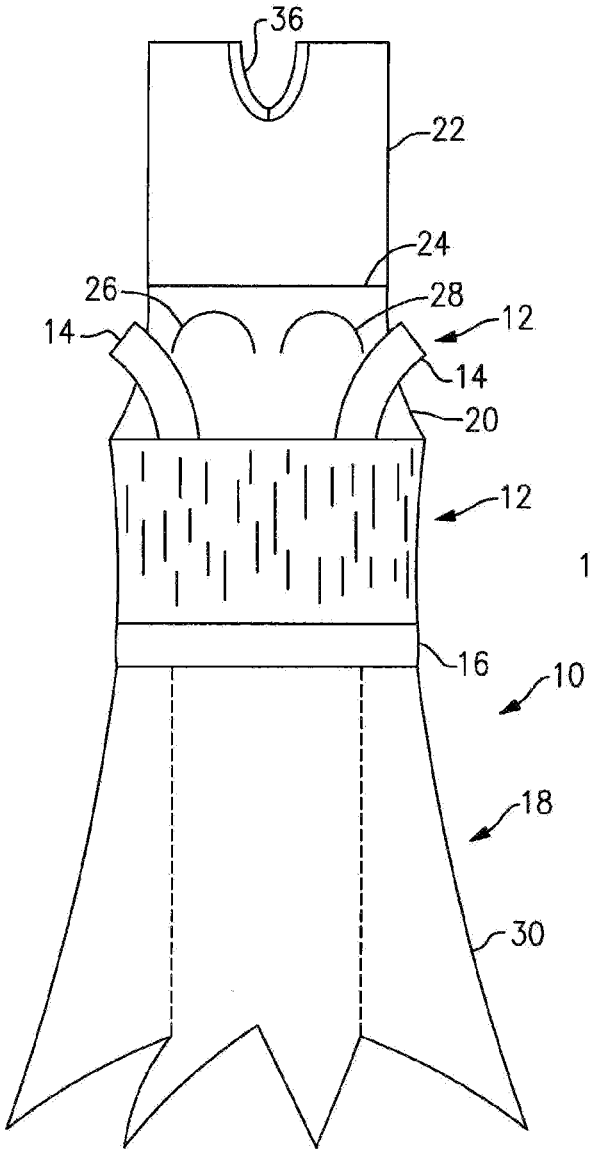
FIG. 3 is a plan view of the front of the garment shown in FIG. 2 with the inner layer of the garment pulled upwardly and inside-out.
Figure 4:
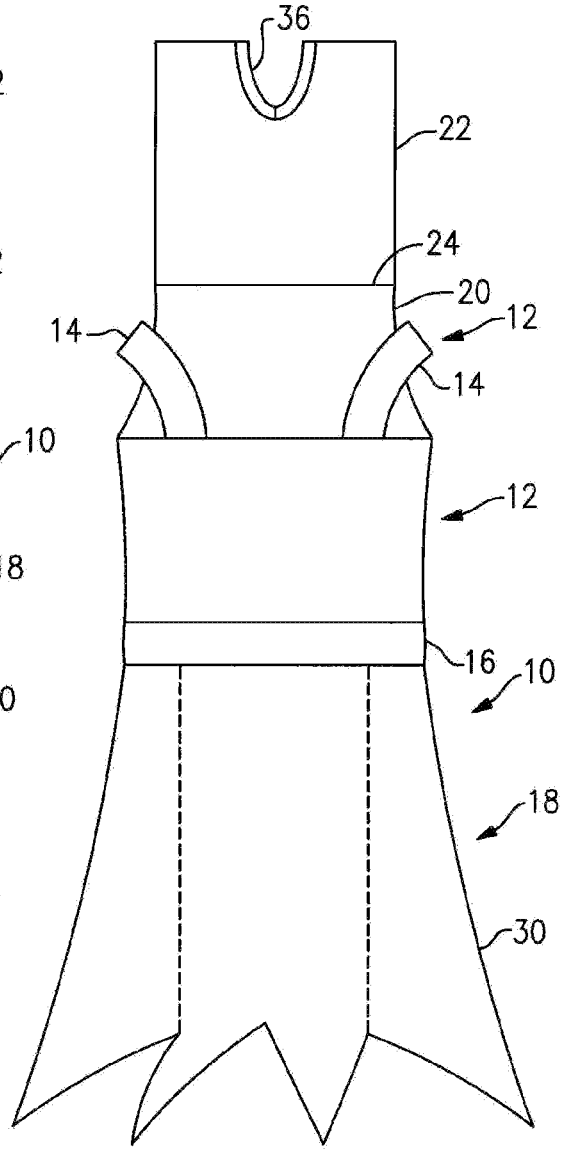
FIG. 4 is a plan view of the back of the garment shown in FIG. 3, again, with the inner layer of the garment pulled upwardly and inside-out.

FIG. 3 is a front view of the inner layer pulled upwardly and inside-out with respect to the intermediate and outer layers, and FIG. 4 is a back view of the garment 10 in the condition shown in FIG. 3. It will be appreciated from reviewing FIGS. 3-5 that the intermediate and outer layers are attached, such as by sewing, lacing, buttons, zippers, snap-fit connectors, or hook and loop fasteners a/k/a VELCRO® along the upper edge of the inner layer 20 of the bodice section 12. The invention contemplates that the intermediate and the outer layers may be secured in a similar manner to the inner layer alternately or additionally in the region of the seam 24 that joins the bodice section 20 of the inner layer and the torso/legs portion 22 of the inner layer.

FIG. 3 is a front view of the inner layer pulled upwardly and inside-out with respect to the intermediate and outer layers, and FIG. 4 is a back view of the garment 10 in the condition shown in FIG. 3. It will be appreciated from reviewing FIGS. 3-5 that the intermediate and outer layers are attached, such as by sewing, lacing, buttons, zippers, snap-fit connectors, or hook and loop fasteners a/k/a Velcro® along the upper edge of the inner layer 20 of the bodice section 12. The invention contemplates that the intermediate and the outer layers may be secured in a similar manner to the inner layer alternately or additionally in the region of the seam 24 that joins the bodice section 20 of the inner layer and the torso/legs portion 22 of the inner layer.

The drawings of FIGS. 6A-G, 7A-E, and SA-D will now be described. These drawings generally represent preferred configurations or pattern pieces for making the garment 10 shown in FIGS. 1-5. The drawings are not drawn to scale. Also, when dimensions of the pieces are provided, it is understood that such dimensions are with respect to the garment 10 in accordance with the aforedescribed preferred embodiment, and further, for a "small" women's size. Accordingly, the dimensions are provided to describe a particular preferred embodiment of the present invention and should not necessarily be construed as constricting or limiting the characteristics or nature of the present invention.

Figure 6A:
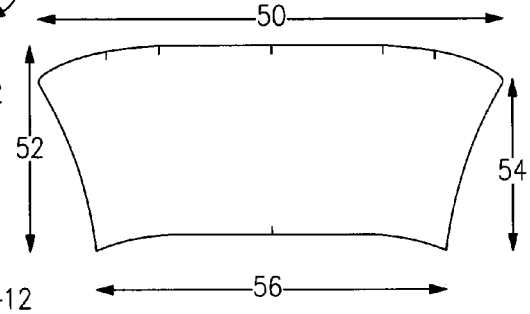
FIGS. 6A-6D are pattern configurations for portions of the garment shown in FIG. 1.
Figure 6B:
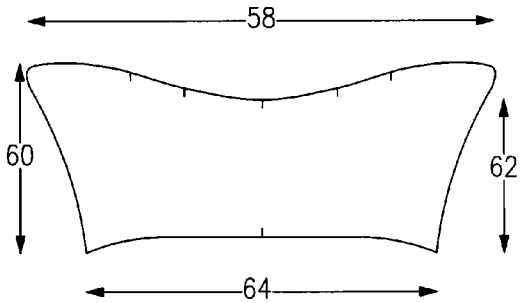
Figure 6C:
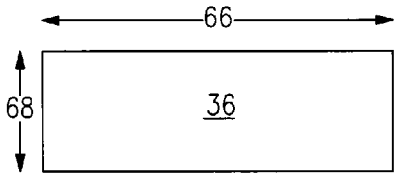
Figure 6D:
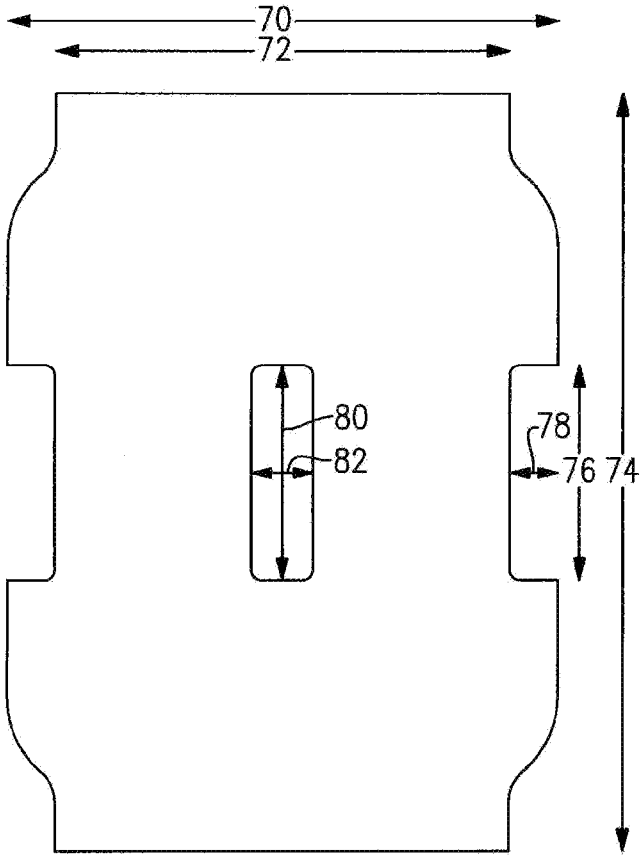

FIGS. 6A-D generally show the pieces that form the inner layer of the garment 10, which inner layer may be considered a shaping and smoothing body suit with legs. FIG. 6A depicts the front portion of the bodice section 20 of the inner layer. The dimension indicated by the arrows 50 is 18.4 inches, by the arrows 52 is 7.2 inches, by the arrows 54 is 6.6 inches, and by the arrows 56 is 13 inches. FIG. 6B depicts the piece pattern for the back portion of the bodice section 34 of the inner layer. The dimension indicated by the arrows 58 is 15.8 inches, by the arrows 60 is 6.6 inches, by the arrows 62 is 5.6 inches, and by the arrows 64 is 12 inches. FIG. 6C depicts one of a pair of two crotch inserts 36, as best shown in FIGS. 3-5 and 6G. The dimension indicated by arrows 66 is 15.1 inches, and by the arrows 68 is 4 inches. Each of the rectangular shaped crotch inserts 36 is folded midway between its longitudinal ends to form a two-layer piece of material prior to being sewn to the crotch region of the torso/legs portion 22 of the inner layer. FIG. 6D depicts a single piece of material that may be used to form the torso/legs portion 22 of the inner layer. The dimension indicated by the arrows 70 is 25.5 inches, by the arrows 72 is 22.5 inches, by the arrows 74 is 37 inches, by the arrows 76 is 10.1 inches, by the arrows 78 is 2.4 inches, by the arrows 80 is 10.1 inches, and by the arrows 82 is 2.4 inches.

The single piece of material shown in FIG. 6D is a sheet of flexible fabric designed to have a specific shape consisting of an outer peripheral5 configuration including four corners and two pairs of opposing sides. One pair of opposing sides is linear and parallel and the other pair of opposing sides has a top, center, and bottom section. The top and bottom sections of the other pair are curvilinear and include a first end at one of the four corners and a curved portion that forms a second end at the center section, the two ends are spaced apart a distance of a substantially rectangular-shaped recess in the center section such that an inner edge of the substantially rectangular-shaped recess is aligned with the first end at one of the four corners. The sheet of flexible fabric is further designed to include an inner peripheral configuration that defines a rectangular opening through the sheet. The rectangular opening has substantially the same dimensions as the substantially rectangular-shaped recess in the center section and is positioned centrally in the sheet substantially equidistant between the two pairs of opposing sides. Once the sheet shown in FIG. 6D has been fashioned into a bodysuit by folding and joining selected edges, the substantially rectangular-shaped, recessed, center section and rectangular opening in the sheet are disposed in a crotch area of a person when the body suit is worn.

Figure 6E:
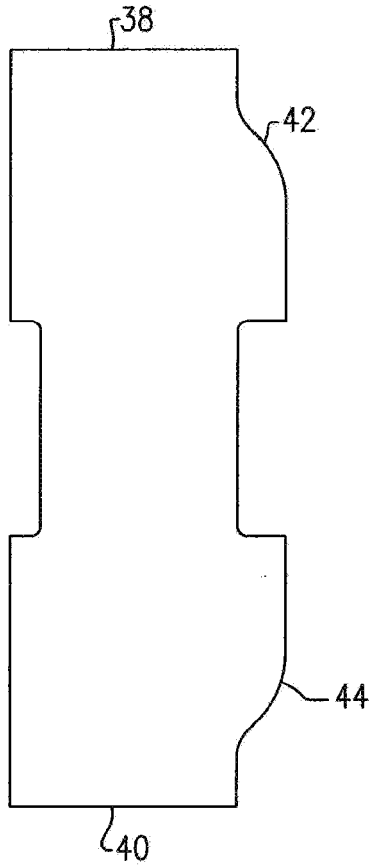
FIG. 6E is the pattern configuration shown in FIG. 6D folded about vertical line extending midway between the two lateral ends of the pattern shown in FIG. 6D.
Figure 6F:
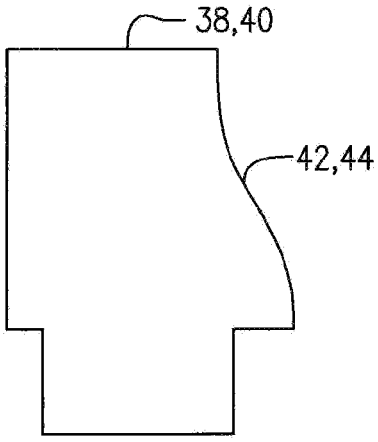
FIG. 6F is the pattern configuration shown in FIG. 6E after stitching selected edges together to form a tube and pulling one end of the tube over and upward to the other end of the tube.
Figure 6G:
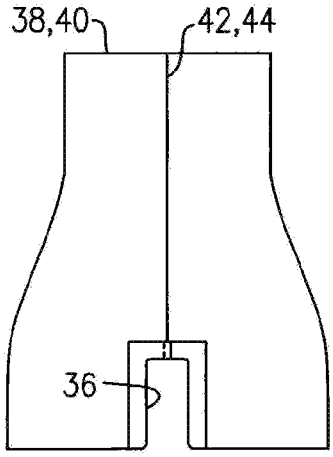
FIG. 6G is the torso/legs portion of the garment shown in FIGS. 1-5 formed from the piece of material shown in FIG. 6F with crotch inserts added.

The process of making the torso/legs portion 22 of the inner layer will be described with reference to FIG. 6E-G. FIG. 6F is the pattern piece shown in FIG. 6D as folded vertically midway between its lateral edges. Preferably the overlapping edges 42 and the overlapping edges 44 of the piece shown in FIG. 6E will be sewn together using "514" safety seam stitching. The edges 38, 40 will be unstitched at this stage of the process and open such that the piece shown in FIG. 6E is substantially a tube. Next, the edge 40 is rolled outwardly and pulled upward over the material, toward the edge 38 so as to create a two-layered piece of material as shown in FIG. 6F. In the condition shown in FIG. 6F, it will be appreciated that the rough seams created by safety stitching along edges 42 and 44 will be disposed interiorly of the two-layer fabric, thereby creating a relatively smooth seam both on the outside and on the inside of the material as depicted in FIG. 6F. The torso/legs portion will then look somewhat like the depiction shown in FIG. 6G.

Any underwire channelings 26, 28 may then be secured such as by stitching to the inner side of the bodice portion 20 of the inner layer. Any underwire may be inserted into the channelings 26, 28 at this juncture in the process. Then the edges 38, 40 of the torso/legs portion 22 are stitched to the lower edge of the bodice portion 20 of the inner layer, such that the stitched edges 40, 44 form a seam centered along the lower spine of the wearer.

As shown in FIG. 6F, the crotch area of the torso/legs portion 22 is open. The rectangular pieces forming the crotch inserts 36 shown in FIG. 6C, which have been folded and stitched, are then turned inside out so that the rough portion of the stitching is disposed on the inside of the two-layer material. The lateral edges of each folded crotch insert 36 are then disposed along each leg of the torso/legs portion 22, as depicted in FIG. 6G, and each lateral edge of each crotch insert is attached such as by sewing to the adjacent portion of the leg section of the pants 22. The lengths of the two crotch inserts 36 are selected so that they overlap in the upper, central crotch region of the torso/legs portion 22 as shown by the solid and the dashed lines in FIG. 6G. The overlapping portions of the crotch inserts 36 are not sewn together, so as to provide a loose, flapped opening that may facilitate urination by the wearer of the garment 10 without peeling off the garment 10. Alternatively, the crotch inserts 36 may be sewn or otherwise secured together in the upper, central crotch region of the torso/legs portion 22, or there may be a single continuous crotch insert extending entirely across the crotch region. The invention also contemplates that the edges of the crotch area of the torso/legs portion 22 may be sewn together without any crotch insert or alternatively provided with cotton, a cotton blend, or another soft fabric secured such as by stitching to the crotch region of the torso/legs portion 22.

When the torso/legs portion 22 is in the configuration shown in FIGS. 6F and G, the torso/legs portion 22 is double layered, which provides additional elastic strength and correspondingly enhanced body shaping properties. Also, when the torso/legs portion 22 is in such configuration, it will be appreciated that the lowest edge of each leg is folded, and without a seam, and preferably not reinforced. This folded feature of the legs portion helps prevent excessive constriction of the adjacent region of the leg, which in turn permits better blood flow through the leg and minimizes bulging of the leg beneath the edge. Likewise, it will be appreciated that the lowest edge of each crotch insert 36 is also folded, and without a seam, and preferably is not reinforced, such that a continuous folded edge extends around each leg of the wearer. The invention also contemplates that the torso/legs portion or the entire bodysuit with legs may be fashioned without any seams and without any crotch inserts.

Figure 7A:
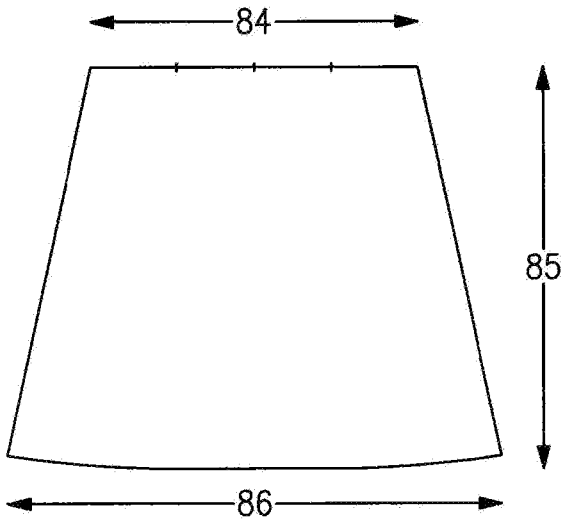
FIGS. 7A-7E are pattern configurations for other pieces of the garment shown in FIG. 1.
Figure 7B:
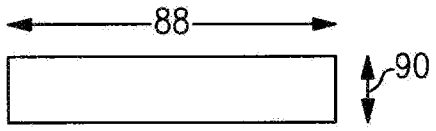
Figure 7C:
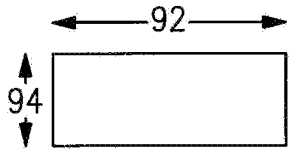
Figure 7D:
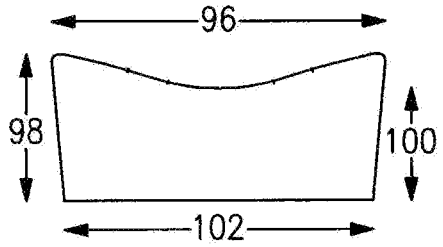
Figure 7E:
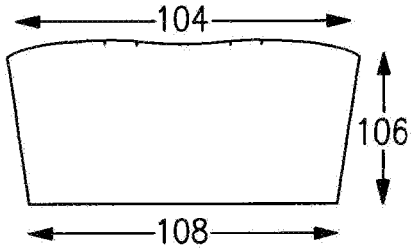

FIGS. 7A, 7D, and 7E, generally show the pieces that form the intermediate layer or overlay comprising the dress. FIG. 7B depicts one of two identical front and back pieces of the waist band 16, and FIG. 7C depicts one of two shoulder straps 14. FIG. 7A depicts one of two identical pieces for the lower portion 32 of the dress, which pieces are sewn along their lateral edges to form the lower portion 32 of the dress. The dimension indicated by the arrows 84 is 14.9 inches, the arrows 85 is 18 inches, and the arrows 86 is 23.3 inches. FIG. 7B, the dimension of the arrows 88 is 152 inches, and the arrows 90 is 2.8 inches. In FIG. 7C, the dimension of the arrows 92 is 11.7 inches, and the arrows 94 is 4.7 inches. FIG. 7D depicts a pattern piece for the back of the upper portion 34 of the dress of the bodice section 12 of the intermediate layer comprising the dress. In FIG. 7D, the dimension of the arrows 96 is 16.8 inches, the arrows 98 is 7.3 inches, the arrows 100 is 5.8 inches, and the arrows 102 is 16.8 inches. FIG. 7E depicts a pattern piece for the front of the upper portion 34 of the dress. In FIG. 7E, the dimension of the arrows 104 is 17.9 inches, the arrows 106 is 7.3 inches, and the arrows 108 is 15.1 inches.

Figure 8A:
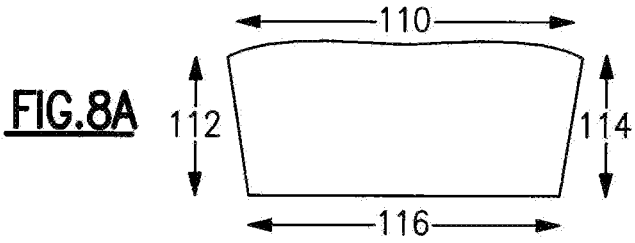
FIGS. 8A-8D are still other pattern configurations for yet other pieces of the garment shown in FIG. 1.
Figure 8B:
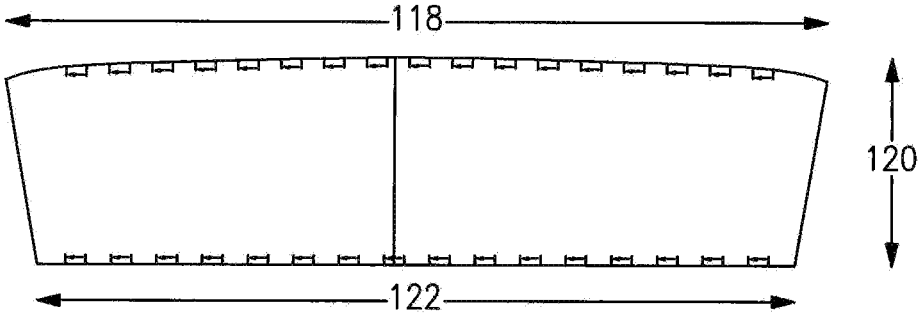
Figure 8C:
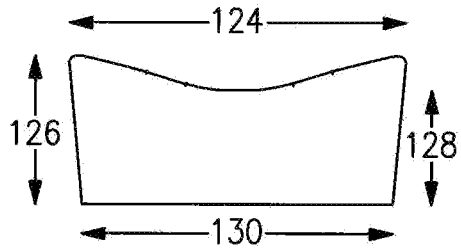
Figure 8D:
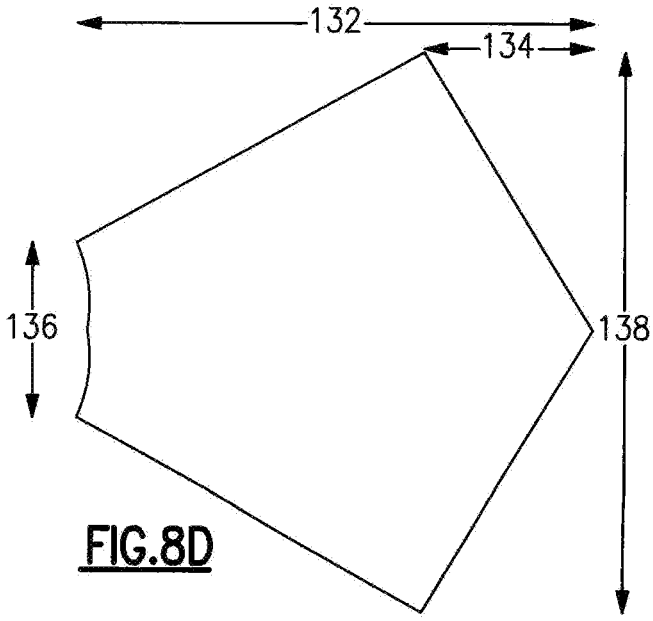

FIGS. 8A-8D generally show the pattern pieces for the outer, exterior, decorative layer of the garment 10. FIG. 8A depicts a piece for the back of the exterior layer of the bodice section 12. The dimension of the arrows 110 is 17.9 inches, the arrows 112 is 7.5, the arrows 114 is 6.9 inches, and the arrows 116 is 15.2 inches. FIG. 8B is pattern piece for the front of the exterior layer of the bodice section 12, and is formed with the aesthetically pleasing tucked pleats. The dimension of the arrows 118 is 34.8 inches, the arrows 120 is 7.8 inches, and the arrows 122 is 30.8 inches. Note that the lateral length of the piece depicted in FIG. 8B is relatively long, but the fact that the material is styled with tuck pleating as indicated by the series of arrows and segmented lines along each lateral edge shortens the effective lateral length. FIG. 8C depicts a pattern piece that is used for the back of external layer of the bodice portion 12 of the garment 10. The dimension of the arrows 124 is 16.7 inches, the arrows 126 is 7.3 inches, the arrows 128 is 5.8 inches, and the arrows 130 is 15.2 inches. FIG. 8D depicts a pattern piece for one of four pieces that from the outer layer of the skirt section 30 of the garment 10. The pieces are joined such as by sewing along their lateral edges with adjacent, identical pieces to form the exterior layer of the skirt section 30. Again, the outer layer of the skirt section 30 of the garment 10 may be pleated, as shown by the dashed lines in FIGS. 1 and 2. The dimension of the arrows 132 is 22 inches, the arrows 134 is 8 inches, the arrows 136 is 7.6 inches, and the arrows 138 is 20 inches.

Preferably the pieces 8A-D are fashioned of a sheer mesh material that is strong, flexible, lightweight, and quick-drying. Also preferably, the material for the pieces 8A-D is elastic, and is formed of eighty percent nylon and twenty percent spandex. The pieces 7A-E are preferably a opaque material that is strong, flexible, lightweight, and quick-drying. Preferably, the material is elastic and is fashioned of seventy-nine percent nylon and twenty-one percent spandex. The pieces of material depicted in FIGS. 6A-G are preferably strong, flexible, lightweight and quick-drying, and are preferably elastic and formed of a composition of sixty percent nylon and forty percent spandex. Preferably at least the inner layer comprising the body suit with legs, and alternatively or additionally, either or both the intermediate and outer layers are formed of a breathable material and are fashioned of a chlorine and bacteria resistant material (which may include a material impregnated or otherwise treated with substances that provide such resistance). Also, at least the inner layer may be fashioned of a wicking material such as may be composed of microfibers that help remove perspiration and other moisture from the wearer's skin.

As previously mentioned, the underwire channeling 26, 28 is preferably fashioned of a soft material, such as cotton, that is attached to the inside of the inner layer material, such as by stitching. Also, it is noteworthy that the construction of the bodice section 12 permits use by women having breasts of most cup sizes.

During certain activities, it is possible that the intermediate layer forming the dress of the garment 10 may become distended a significant distance away from the inner layer of the garment 10. For example, if a woman wearing the garment 10 jumps into a swimming pool, or if a wearer encounters a high velocity wind, then the intermediate layer may move a considerable distance away from the inner layer. The invention contemplates that means for restraining movement of at least the intermediate layer may be employed. The restraining means may include at least one hook and loop fastener a/k/a VELCRO®, with one portion of the fastener attached to the torso/legs portion 22 and the other portion of the fastener attached to the inner surface of the lower portion 32 of the dress. Similarly, the restraining means may include at least one two-piece cooperating snap-fit connector. Likewise, the restraining means may comprise at least one band of material connecting the torso/legs portion 22 and the lower dress portion 32. The band may be elastic and may be stitched to the torso/legs portion and stitched to the lower dress portion 32. FIG. 5 depicts in dashed lines a band 200 that may extend between and interconnect the inner surface of the lower portion 32 of the dress and the torso/legs portion 22 by means of a hook and loop fastener member 202 or a snap fit connector member 204.

It should also be understood that the garment in accordance with the present invention may comprise simply the inner layer forming the body suit with legs and a single outer layer of material, rather than an inner layer, an intermediate layer, and an outer layer. The invention also contemplates that the inner layer comprising the body suit with legs may be manufactured, sold, and worn alone, independently of any exterior layers. When so worn, the wearer may choose to wear a blouse, shirt, shorts, pants, or other attire over the inner layer. Such inner layer may be manufactured with or without any shoulder straps. The invention further contemplates that only the torso/legs portion of the body suit may be manufactured, sold, and worn alone, independently of any other layers and may be worn with or without a separate halter top or bra.

Likewise, when so worn, the wearer may choose to wear a blouse, shirt, shorts, pants or other attire over the torso/legs portion.

From the foregoing description of the preferred embodiment, it will be appreciated that the garment 10 may be worn by a woman in a variety of activities. Because the inner layer of materials is preferably elastic and body forming and because the materials from which the garment 10 is fabricated are preferably quick-drying, the garment 10 may be utilized as swimwear without a need to change clothing either before or after swimming. The garment 10 helps to shape the wearer's body with desirable contours and still present a feminine, aesthetic appeal. It will be further appreciated that the garment 10 as described above is sufficiently comfortable and aesthetically appealing so as to be worn without changing the garment when transitioning from one activity to another activity. So, for example, a woman may wear the garment 10 at the beach in the afternoon, at a restaurant for dinner, and at dancing after dinner without changing the garment 10.

It will be appreciated that a wearer of the garment 10 may choose to cover the upper portion of the garment 10 with a blouse or jacket, as desired, and that several accessories may be worn or used with the garment such as matching, coordinated waist belts, purses, handbags, scarves, and hats.

The exterior layer, and the intermediate layer, may be fashioned in a wide variety of styles including a solid color, striped, patterned, printed, etc., may include embellishments such as pleats, and may be fashioned in various configurations such as a tulip, a halter, ruched, and a tiered tank Any of layers may be embellished with embroidery, ruffles, lace, buttons, and other similar features.

Thus, while various embodiments of the present invention have been described herein, it will be appreciated that the invention includes embodiments other than those specifically illustrated or described and that changes in the form and arrangement of parts and the specific manner of practicing the invention may be varied without departing from the nature or scope of the invention. Consequently, the invention may be practiced otherwise than is specifically described above.

I claim:

1. A garment adapted to be used as swimwear, activewear, and casual wear, said garment comprising:

a body-shaping inner layer adapted to be disposed adjacent to a wearer's skin, said inner layer including a lower section adapted to cover a portion of the torso and upper thighs of the wearer and an inner bodice section joined to said lower section, wherein the body-shaping inner layer is fashioned by folding and joining selected edges of a sheet of flexible fabric, wherein said sheet of flexible fabric is designed to have a specific shape consisting of (a) an outer peripheral configuration including four corners and two pairs of opposing sides (1) a first of the pair of opposing sides, being linear and parallel (2) a second of the pair of opposing sides having a top, center, and bottom section, the top and bottom sections being curvilinear and including a first end at one of the four corners and a curved portion that forms a second end at the center section, the two ends spaced apart a distance of a substantially rectangular-shaped recess in the center section such that an inner edge of the substantially rectangular-shaped recess is aligned with the first end at one of the four corners, and (b) an inner peripheral configuration defining a rectangular opening through said sheet, said rectangular opening having substantially the same dimensions as the substantially rectangular-shaped, recessed, center section and positioned centrally in said sheet substantially equidistant between the two pairs of opposing sides, and wherein said substantially rectangular-shaped, recessed, center section and said rectangular opening in said sheet are disposed in a crotch area of a person when the body suit is worn conformingly against and about, and compressively shapes a person's torso and upper thighs, and an intermediate layer disposed over said inner layer, said intermediate layer including a lower portion of a dress disposed over said lower section and an intermediate bodice section including an upper portion of a dress joined to said lower dress portion and disposed over said inner bodice section; and an outer layer permanently affixed to and disposed over said intermediate layer.

2. A garment according to claim 1 wherein said inner layer is permanently affixed to said intermediate layer and said outer layer substantially only along the upper edge of said inner bodice section.

3. A garment according to claim 1 further including a waist band interconnected between said lower dress portion and said upper dress portion.

4. A garment according to claim 3 wherein said waist band is fashioned of a substantially elastic material.

5. A garment according to claim 1 further comprising a layer of padding interposed between said inner bodice section and said upper dress portion.

6. A garment according to claim 1 wherein said inner bodice section possesses a pair of underwire channelings and a pair of underwires each extending through a corresponding one of said channelings and adapted to be disposed beneath and to support the breasts of a person wearing the garment.

7. A garment according to claim 1 wherein said inner layer is fashioned of a sheet of a substantially elastic material capable of stretching and contracting in two orthogonal directions extending through the plane of the sheet.

8. A garment according to claim 7 wherein said elastic material comprises a combination of nylon and spandex.

9. A garment according to claim 8 wherein said intermediate layer comprises a combination of nylon and spandex and said outer layer comprises a combination of nylon and spandex.

10. A garment according to claim 1 wherein said lower dress portion extends downwardly a distance sufficient to cover essentially all of said lower section.

11. A garment according to claim 1 further comprising means interconnecting said lower dress portion and said lower section for restraining said lower dress portion from moving away from said lower section.

12. A garment according to claim 11 wherein said means selectively restrains said lower dress portion from moving away from said lower section.

13. A garment according to claim 11 wherein said restraining means comprises at least one connecting band extending between said lower section and said lower dress portion.

14. A garment according to claim 1 wherein said lower section is adapted to substantially completely cover the upper thighs of the wearer to a point in the range of about three to eight inches below the wearer's crotch.

15. A body suit adapted to be worn conformingly against and about, and adapted to compressively shape, a person's torso and upper thighs, said body suit fashioned by folding and joining selected edges of a sheet of flexible fabric, wherein said sheet of flexible fabric is designed to have a specific shape consisting of:

(a) an outer peripheral configuration including four corners and two pairs of opposing sides (1) a first of the pair of opposing sides, being linear and parallel (2) a second of the pair of opposing sides having a top, center, and bottom section, the top and bottom sections being curvilinear and including a first end at one of the four corners and a curved portion that forms a second end at the center section, the two ends spaced apart a distance of a substantially rectangular-shaped recess in the center section such that an inner edge of the substantially rectangular-shaped recess is aligned with the first end at one of the four corners, and (b) an inner peripheral configuration defining a rectangular opening through said sheet, said rectangular opening having substantially the same dimensions as the substantially rectangular-shaped, recessed, center section and positioned centrally in said sheet substantially equidistant between the two pairs of opposing sides, and wherein said substantially rectangular-shaped, recessed, center section and said rectangular opening in said sheet are disposed in a crotch area of a person when the body suit is worn conformingly against and about, and compressively shapes a person's torso and upper thighs.

* * * * *